US005928466A

United States Patent [19]

Yu Chen

[11] Patent Number: 5,928,466

[45] Date of Patent: Jul. 27, 1999

[54] TAPE SUPPORT HAVING A PROTECTIVE MEMBER

[76] Inventor: Hsiu-Man Yu Chen, No. 27, Sec. 1, Da Fu Road, Tan Tzu Hsiang, Taichung Hsien, Taiwan

[21] Appl. No.: 08/947,886

[22] Filed: Oct. 9, 1997

[51] Int. Cl.[6] ..... B32B 31/00

[52] U.S. Cl. ..... 156/527; 225/20

[58] Field of Search ..... 156/523, 527, 156/577, 579; 225/20

[56] References Cited

U.S. PATENT DOCUMENTS 3,404,058 10/1968 Fink, Jr. ..... 156/527

4,915,769 4/1990 Heil et al. ..... 156/527

5,393,367 2/1995 Yu Chen ..... 156/527 X

*Primary Examiner*—James Engel

[57] ABSTRACT

A tape support includes a hub for rotatably engaging with a tape, and includes a casing and a frame for slidably receiving a cutter device which has a cutter edge for cutting the tape. A protective cover is slidably engaged in the casing and has an outer end biased outward of the casing for shielding the cutter edge of the cutter device and for preventing the cutter edge from hurting people and for allowing the cutter edge to cut the tape. The casing includes a chamber for receiving a resilient member which may bias the protective cover to shield the cutter edge.

6 Claims, 2 Drawing Sheets

TAPE SUPPORT HAVING A PROTECTIVE MEMBER

BACKGROUND OF THE INVENTION

1. Field of the Invention

The present invention relates to a tape support, and more particularly to a tape support having a protective member.

2. Description of the Prior Art

Typical tape supports comprise a frame body including a hub for rotatably receiving a tape and including a cutter device for cutting the tape and for allowing the tape to be easily used. However, no protective member has been provided for covering the cutter device and for preventing the cutter device from hurting people.

The present invention has arisen to mitigate and/or obviate the afore-described disadvantages of the conventional tape supports.

SUMMARY OF THE INVENTION

The primary objective of the present invention is to provide a tape support having a protective cover for shielding and covering the cutter device and for preventing the cutter device from hurting the user.

In accordance with one aspect of the invention, there is provided a tape support comprising a body including a hub for rotatably engaging with a tape, and including a frame, a cutter device secured to the frame and having a cutter edge for cutting the tape, and a protective cover means for shielding the cutter edge of the cutter device and for preventing the cutter edge from hurting people and for allowing the cutter edge to cut the tape.

The protective cover means includes a casing having a channel, and includes a cover slidably engaged in the channel of the casing, and means for biasing the cover outward of the casing to shield the cutter edge of the cutter device. The casing includes a chamber for receiving the biasing means, the cover includes a first end slidably engaged in the chamber and engaged with the biasing means and includes a second end extended outward of the casing for covering the cutter edge of the cutter device. The body includes a post, and a cap secured to the post, the cap includes a flap for engaging in the chamber of the casing and includes a stud for securing in the post and for securing the cap to the post.

The frame includes at least one projection for engaging with the cutter device and for retaining the cutter device in place.

The body further includes a barrel rotatably secured thereon for engaging with the tape and for guiding the tape. The body includes a post for rotatably engaging with the barrel and includes a cap secured to the post for retaining the barrel in place.

The body further includes a pair of rollers rotatably secured thereon for engaging with the tape and for guiding the tape. The body includes two rods for engaging with the rollers and each having a head and a slit formed in the head for separating the head into two halves and for increasing a resilience of the head, the rollers each includes a bore for engaging with the head and each includes an annular shoulder for engaging with the head and for allowing the rollers to be rotatably secured to the body.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
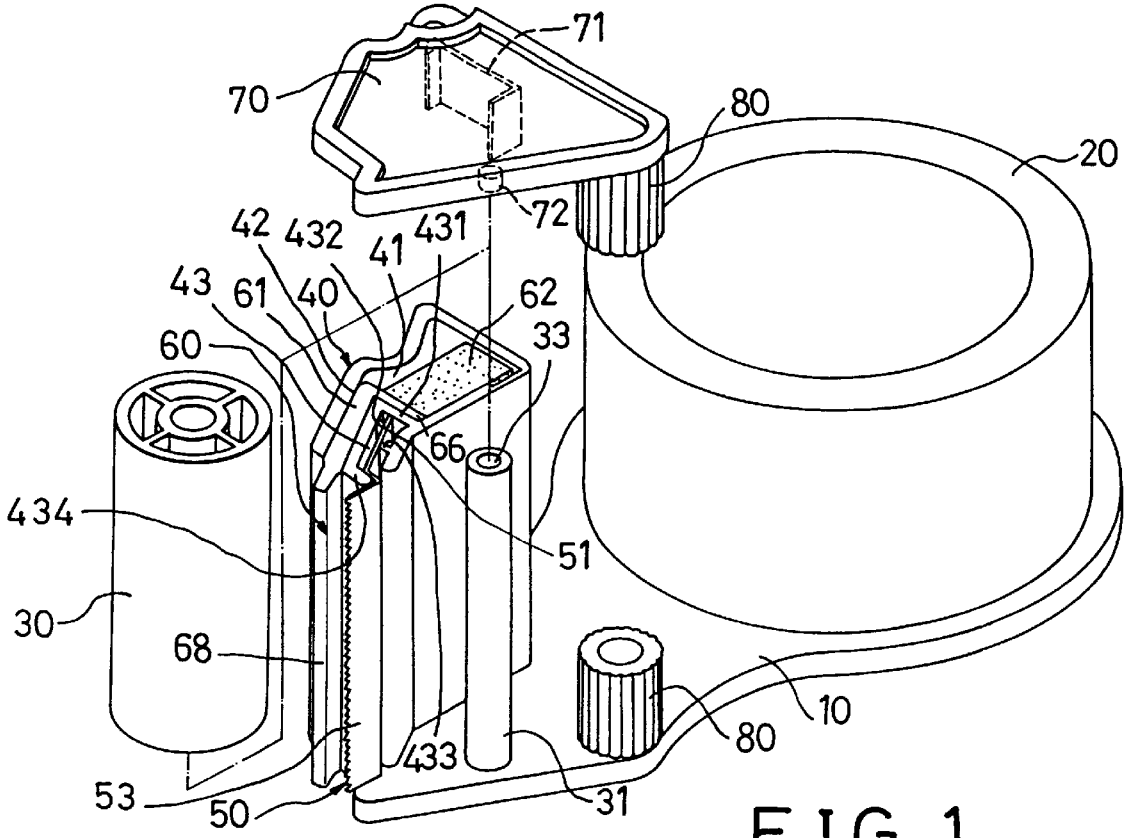
FIG. 1 is an exploded view of a tape support in accordance with the present invention.
Figure 2:
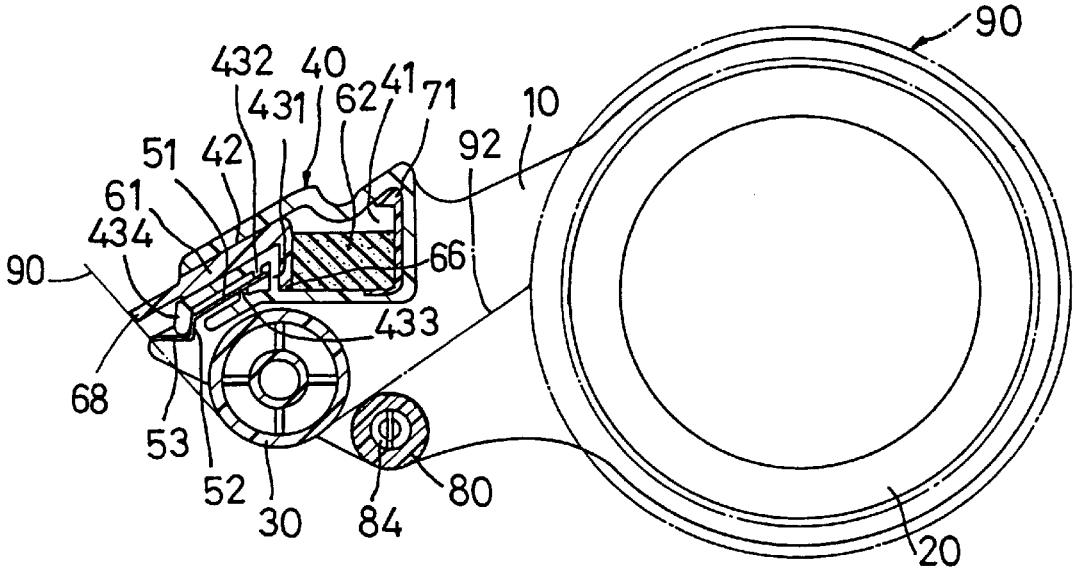
FIGS. 2 and 3 are partial cross sectional views illustrating the operation of the tape support.

Referring to the drawings, and initially to FIGS. 1 and 2, a tape support in accordance with the present invention comprises a body 10 including a hub 20 for rotatably engaging with a tape 90 and including a post 31 for rotatably engaging with a barrel 30 and including a casing 40 provided beside the post 31 and substantially parallel to the post 31. The casing 40 includes a chamber 41 for engaging with a resilient member, such as a spongy member or a rubber member 62. The casing 40 includes a channel 42 and includes a frame 43 provided beside the channel 42 for engaging with a cutter device 50. A partition 431 is provided and formed between the frame 43 and the chamber 41 of the casing 40. The frame 43 includes one or more projections 432, 433 for engaging with the rear portion of the cutter device 50 that is engaged in the frame 43 and for retaining the cutter device 50 in place. The frame 43 further includes a flange 434 for engaging with a bent portion or a shoulder 52 formed in the middle portion of the cutter device 50 and for retaining the cutter device 50 in place. The cutter edge 53 of the cutter device 50 is exposed and extended outward of the frame 43 for cutting the tape 90 engaged on the hub 20 of the tape support.

A protective cover 60 is slidably engaged in the channel 42 of the casing 40 and is substantially L-shaped having one end or inner end 66 slidably engaged in the chamber 41 of the casing 40 and engaged with the resilient member 62 for allowing the protective cover 60 to be depressed inward of the chamber 41 against the resilient member 62 and for allowing the other end or the outer end 68 of the protective cover 60 to be biased outward of the casing 40 by the resilient member 62 for shielding and covering the cutter device 50 (FIG. 2).

Figure 4:
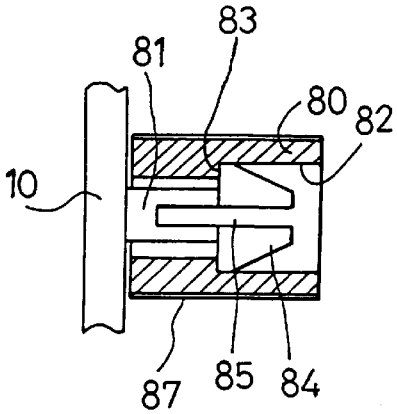
FIG. 4 is a partial cross sectional view illustrating the securing engagement of the roller to the tape support.

A cap 70 includes a flap 71 engaged in the chamber 41 of the casing 40 and provided for being secured to the casing 40 by fasteners or welding processes or by force-fitting configuration. The cap 70 includes a stud 72 for force-fitting in the end hole 33 of the post 31 and for further securing to the post 31 by such as adhesive material, or welding process, or force-fitting engagement, or by fasteners. The cap 70 may be used for retaining the elements in place, including at least the resilient member 62, the barrel 30, the cutter device 50 and the protective cover 60. The body 10 and the cap 70 each includes a roller 80 rotatably secured thereto for engaging with the tape 90 and for guiding the movement of the tape 90. As shown in FIG. 4, the body 10 and the cap 70 each includes a rod 81 having a frustum-shaped head 84 and having a slit 85 formed in the head 84 for separating the head 84 into two separated members and for increasing the resilience of the head 84. The rollers 80 each includes a bore 82 for engaging with the rod 81 and each includes an annular shoulder 83 formed in the bore 82 for engaging with the head 84 of the rod 81 and for allowing the rollers 80 to be rotatably secured to the body 10 and the cap 70 respectively. The rollers 80 each includes a number of ribs 87 formed on the outer peripheral portion for engaging with the tape 90.

Figure 3:
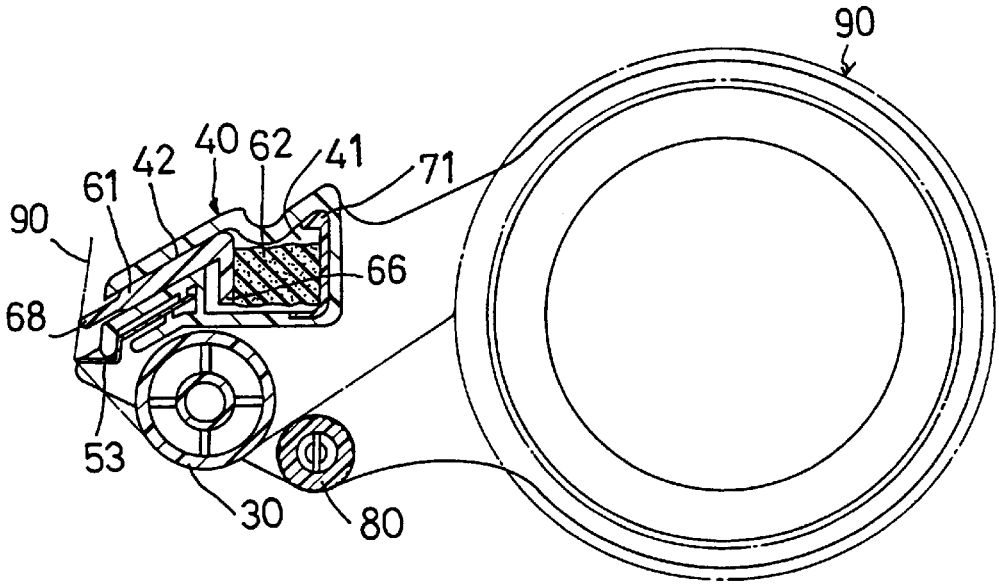

In operation, as shown in FIG. 2, the outer end 68 of the protective cover 60 is biased outward of the casing 40 and is slightly extended forward beyond the cutter edge 53 of the cutter device 50 for shielding and for protecting the cutter edge 53 and for preventing the cutter edge 53 from hurting people inadvertently. As shown in FIG. 3, when the cutter edge 53 and the outer end 68 of the protective cover 60 force the tape 90 against an object to be packaged, the outer end 68 of the protective cover 60 may be depressed inward of the casing 40 against the resilient member 62 for allowing the cutter edge 53 to be exposed and for allowing the cutter edge 53 to cut the tape 90.

Accordingly, the tape support in accordance with the present invention includes a protective cover for shielding and covering the cutter device and for preventing the cutter device from hurting the user.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tape support comprising:

a body including a hub for rotatably engaging with a tape, and including a frame, a cutter device secured to said frame and having a cutter edge for cutting the tape, and a protective cover means for shielding said cutter edge of said cutter device and for preventing said cutter edge from hurting people and for allowing said cutter edge to cut the tape, said protective cover means including a casing having a channel formed therein, and including a cover slidably engaged in said channel of said casing, and means for biasing said cover outward of said casing to shield said cutter edge of said cutter device, said casing including a chamber formed therein for receiving said biasing means, said cover including a first end slidably engaged in said chamber and engaged with said biasing means and including a second end extended outward of said casing for covering said cutter edge of said cutter device, said body including a post and a cap secured to said post, said cap including a flap for engaging in said chamber of said casing and including a stud for securing in said post and for securing said cap to said post.

2. The tape support according to claim 1, wherein said frame includes means for retaining said cutter device in place.

3. The tape support according to claim 1, wherein said body further includes a barrel rotatably secured thereon for engaging with the tape and for guiding the tape.

4. The tape support according to claim 3, wherein said body includes a post for rotatably engaging with said barrel and includes a cap secured to said post for retaining said barrel in place.

5. The tape support according to claim 1, wherein said body further includes a pair of rollers rotatably secured thereon for engaging with the tape and for guiding the tape.

6. The tape support according to claim 5, wherein said body includes two rods for engaging with said rollers and each having a head and a slit formed in said head for separating said head into two halves and for increasing a resilience of said head, said rollers each includes a bore for engaging with said head and each includes an annular shoulder for engaging with said head and for allowing said rollers to be rotatably secured to said body.

* * * * *